United States Patent [19]

Patton

[11] 3,933,618

[45] Jan. 20, 1976

[54] GAS GENERATION APPARATUSES AND PROCESSES

[75] Inventor: Colonel E. Patton, Farmington, N. Mex.

[73] Assignee: Blue Ember Flame Corporation, Farmington, N. Mex.

[22] Filed: Mar. 11, 1974

[21] Appl. No.: 449,715

[52] U.S. Cl. ..... 208/8; 48/77; 48/101; 48/197 R; 48/210; 201/27; 201/30

[51] Int. Cl.[2] ..... C10G 1/00

[58] Field of Search ..... 48/101, 210, 77, 197 R, 48/90; 208/8; 201/27, 30

[56] References Cited

UNITED STATES PATENTS

| | | | |
|---|---|---|---|
| 2,131,702 | 9/1938 | Berry | 48/210 |
| 3,454,383 | 7/1969 | Pirsh et al. | 48/101 |

*Primary Examiner*—S. Leon Bashore
*Assistant Examiner*—George C. Yeung
*Attorney, Agent, or Firm*—Ely Silverman

[57] ABSTRACT

Readily maintained and operated apparatus for generation of combustible gas mixture and motor fuels from coal with cycling of the heat energy sources for heating coal.

4 Claims, 6 Drawing Figures

GAS GENERATION APPARATUSES AND PROCESSES

BACKGROUND OF THE INVENTION

1. The Field of the Invention

The field of this invention is gas making generators and domestic plants.

2. Description of the Prior Art

Coal gas has been deemed expensive because only the volatile portion distills off and the remaining coke is deemed relatively valueless: usual apparatuses for producing coal gas have been bulky and expensive or not easily installed, maintained or controlled.

SUMMARY OF THE INVENTION

A retort operating under a slight vacuum is arranged in a readily installed, maintained and controlled system that provides for using the thermal energy of the products of distillation to produce added gas from the coal. The batch apparatus retort is particularly readily emptied and filled.

DESCRIPTION OF THE PREFERRED EMBODIMENTS

Figure 1:
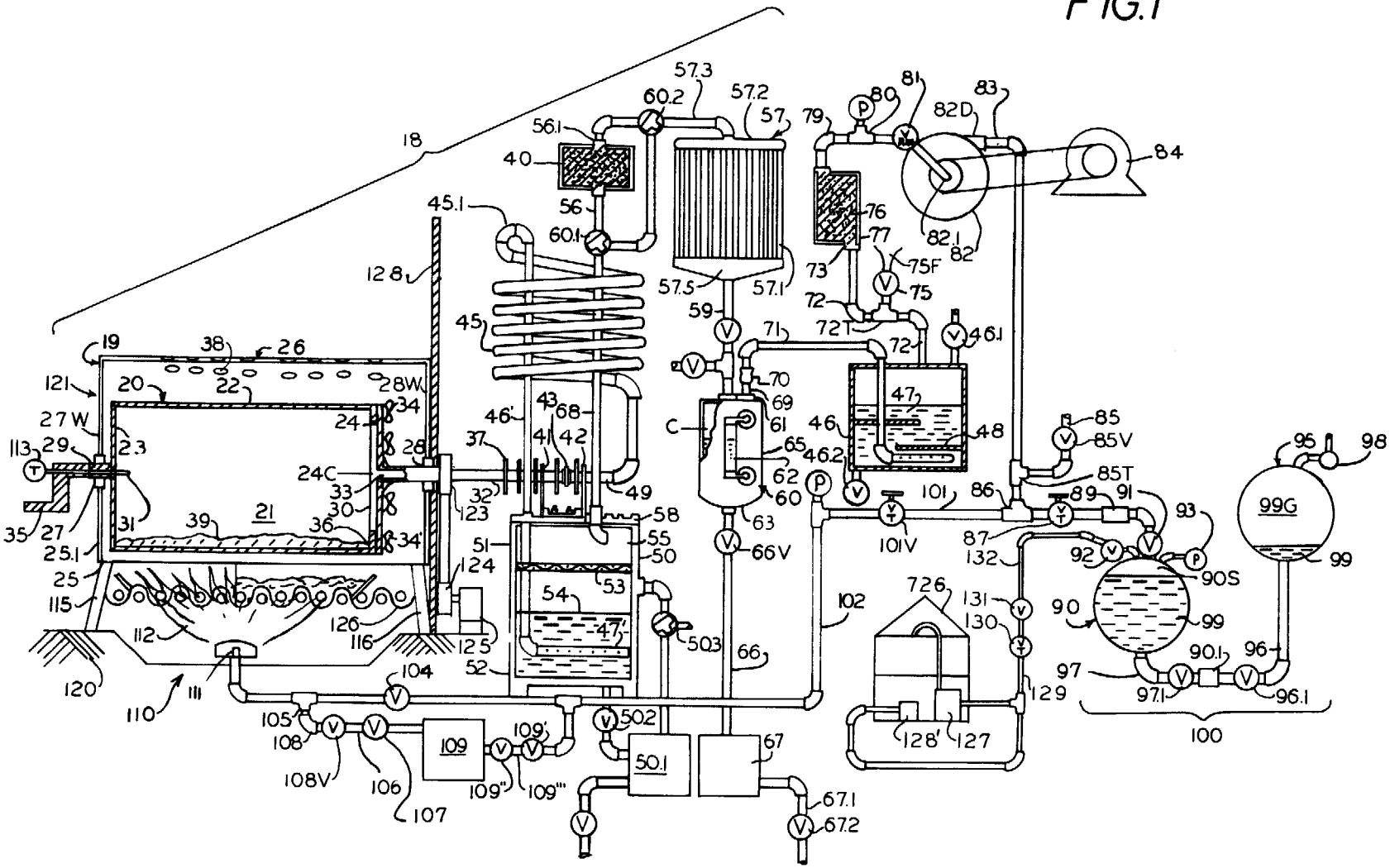
FIG. 1 is a diagrammatic representation, partly in section, of a batch operating system according to this invention.

The system of this invention, in one embodiment, 18, comprises, in operative combination, a retort assembly 19, a washer assembly 50, a condenser and collector assembly 60, a pump and storage assembly 100 and a heating assembly 110.

The retort assembly 19 comprises, in operative combination, a cylindrical retort subassembly 20 and a hood subassembly 121. The retort subassembly comprises a retort tank 20.1 and a discharge pipe 32 and handle 29. Tank 20.1 is composed of a rigid imperforate cylindrical side wall 22, a vertical circular flat imperforate left end wall 23 and a removable right vertical circular flat end wall or lid 24. Walls 22 and 23 are permanent joined in a gas tight and firm manner as by welding. Wing nuts 34, 34', 34'' and the like releasably yet firmly hold the lid 24 to a rigid shoulder 30 on the right side, as shown in FIG. 1, of cylindrical wall 22. The shoulder 30 is a flat rigid annulus joined at its periphery to the right hand edge of wall 22. With the wing nuts tightened, the walls 22, 23 and 24 are firmly joined together and form a substantially gas-tight rigid tank. The soulder 30 has a slot 36 therein at the bottom thereof (shown in FIG. 2) to expedite emptying thereof although not interfering with the substantially gas-tight fit thereof with lid 24 when tank 20.1 is closed by lid 24. The wing nuts hold on to bolts that are attached firmly to shoulder 30. The lid 24 has a center hole 24C for gas to pass into the channel of the pipe 32. A retort chamber 21 is defined by the walls 22, 23 and 24.

The hood assembly 121 is composed of a hood base 25, a hood top 26 and a grid 126. The hood base 25 is a rigid frame or skirt open at its top and at its bottom and comprising a left side (25.1 in FIG. 1), a right side (as shown in FIG. 1), a rear (as shown in FIG. 1) and a front wall similar to the rear wall (and shown in FIG. 6). The frame surrounds the bottom portion of the tank 20.1. The removable top 26 fits on top of the base 25 and extends over the retort top and provides for confining a heating flame 112 applied to the bottom of the retort. A plurality of holes 38 are provided at the top of hood or top 26 for escape of hot gases after such hot confined gases have heated the retort wall or shell 22.

The left side of the hood base supports the bottom of a left journal 27 and the right side of that hood base supports the bottom portion of the right journal bearing 28. Four rigid frame support legs as 115 and 116 are attached to the bottom of the open skirt that forms base 25 and support the frame 25 above the ground 120. These legs also support a grid 126 above a burner 111, and below the bottom of tank 20.1. The grid is located between the walls of hood base 25 and below retort shell wall 22, generally as shown in FIG. 1, above burner 111.

A generally solid and rigid stub shaft 29 is firmly and rigidly fixed to center of rigid circular retort end wall 23 and is co-axial therewith and extends laterally therefrom and is rotatably supported in circular journal bearing 27.

This structure provides that, on removal of the hood top 26 and on release of the wing nuts 34, 34' and 34'', the shell 22 may be separated from its lid 24 and the tube 32 attached to that lid. The combination of parts comprising the handle 35, the wall 23, and the cylindrical wall 22 may then be tilted, as shown in FIG. 3, or lifted completely out of contact with the shell 25 to be filled when tilted as shown in FIG. 2 or may be tilted downward to empty the contents of the chamber 21 onto the grid 126, as shown in FIG. 3.

A rigid handle 35 is firmly attached onto the outer end of the shaft 29 whereby to gently rotate that shaft and the cylindrical retort 20 and the material 39 within the retort and so lightly agitate it in that chamber while being heated therein.

Figure 2:
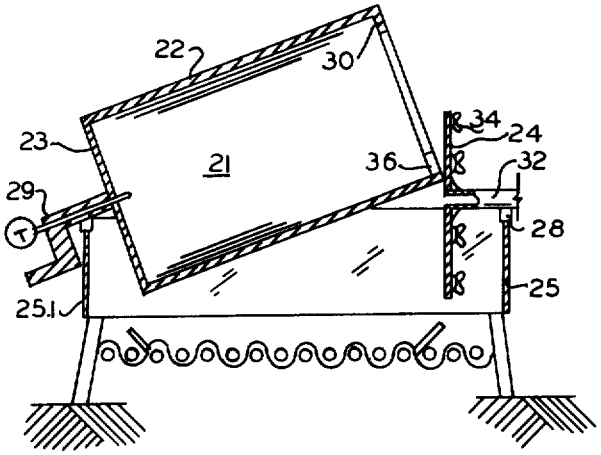
FIG. 2 is a diagrammatic vertical longitudinal view of retort assembly 20 during its charging with coal.
Figure 3:
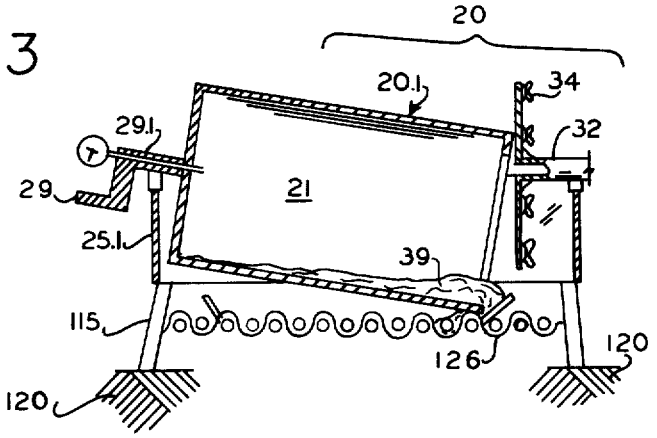
FIG. 3 is a diagrammatic vertical longitudinal showing of the retort assembly 20 during the discharge of coke therefrom.

The arm 29 has a shaft 29.1 that is long enough to allow wall 23 of tank 20.1 to be moved toward left end wall 25.1 and for tank 20.1 to be supported thereon and tilted for filling with coal, as shown in FIG. 2, or applying of coke to grid 126, as shown in FIG. 3, when wall 22 and wall 24 are separated as shown in FIGS. 2 and 3.

A thermally sensitive element 31 is supported on the interior portion of the stub shaft 29 and is connected by an indicator wire passing through the shaft 29 to provide an exteriorily observable indication of temperature in chamber 21 at gauge T (113).

A rigid hollow cylindrical pipe or tube 32 with a central longitudinal channel 33 is coaxial with the center of lid 24 and central hole 24C therein. Tube 32 is firmly fixed at its left end to the outer surface of lid 24 and that tube 32 is rotatably supported on right journal bearing 28 and is also at its right end firmly attached to the left end of joint 43.

Hollow pipe or tube 32 extends from the right hand side of the chamber 21 (right hand as shown in FIG. 1) to bracket support 41 and to the rotatable portion of joint 43. Another bracket 42 is firmly attached to and supports the right hand portion of the joint 43. The left hand side or end of the tube 32 is firmly and rigidly joined to the right hand wall of the rigid chamber 21; the chamber 21 is thus supported by its firm attachment to the rigid tube or hollow pipe 32 and the similarly rigid arm 29.1.

A rotatable joint 43 joins the right hand end of the rotatable tube 32 and the left end of the fixed tube or pipe 49. A plurality of circular thin cooling fins as 37 are attached to the tube 32 and 49 and provide for cooling the gases in the tube 32 prior to the time such gases reach the joint 43 from the hot chamber 21. This cooling of such gases by such fins provides for a reduction of otherwise intense temperature stress in that rotatable joint and thereby protects that joint from dimensional changes resulting from the otherwise high temperature stresses (700° to 900°F.) resulting from contact of such joint with the hot gases passing from chamber 21 via channel 33, which gases were theretofore heated by the flame 112. Rigid vertically extending brackets 41 and 42 are firmly fixed to and are firmly supported on a rigid washer tank 50 which washer is firmly supported on the ground 120.

Cooling coil 45 is a helical metal coil arranged to pass the gases exiting from the chamber 21 into the top of washer assembly 50. The cooling coil 45 is formed of thin walled metal with an interior channel operatively connected at one, feed end, to the discharge end of the chamber 21. That channel extends vertically about a vertical axis to the discharge end 45.1 of the cooling coil 45. The discharge end 45.1 of the cooling coil connects to a cooling coil discharge pipe 46' which pipe 46' has a channel therethrough connecting to the channel of coil 45. Pipe 46' enters the interior of a gastight washing chamber and extends below the upper level of liquid 54 in the wash liquid chamber space 55.

The washer assembly 50 is a rigid structure formed by a rigid cylindrical side wall 51, a rigid horizontal water-tight wall or floor 52 at the bottom thereof and a rigid top 58; walls 51, 58 and 52 are firmly joined together and define a gas-tight washer space 55 wherein a washing liquid 54 is located. A horizontal baffle 53 is located above the top of the liquid 54 and is made of a relatively loosely open mesh, usually one-quarter inch stainless steel.

The discharge pipe 46' from the cooling coil 45 extends vertically below the level of the liquid 54 to a horizontal pipe portion 47' located close to the bottom, 52, of the wash chamber 50. Liquid 54 is a watery solution of brine (NaCl). The washer tank 50 serves as a separator of tar and oil fractions from the mixture of condensed vapors of tar and oil in the vapor mixtures passed into chamber 55. Liquor 54 also separates the tar and oil liquid fraction from each other. The salty liquor 54 serves to separate the oily fractions of different specific gravity from the tar and also avoid creation of foams and oil-in-water suspensions.

Chamber 50 is thus a rigid structure and provides rigid support for the brackets 41 and 42 that support the tubes 49 and 32.

A vertical washer outlet conduit or line 68 extends from its bottom end which is located in the portion of space 55 below top wall or lid 58 above baffle 53 to the inlet 57.3 of a condenser and cooler 57. The line 56 is a metal pipe with a channel therein that is open at its bottom end to space 55 and open at its upper end to and through three way valves 60.1 and 60.2 to the top of a condenser and cooler 57.

The chamber 40 is a rigid air-tight metallic baffled chamber; it is filled with a coarsely divided filtering and catalytic mass such as hopcalite which serves to filter small size solid material and also, in the event of leakage of air from rotatable joint 43 to provide for destruction of any carbon monoxide in that chamber.

Hopcalite is a mixture of metallic oxides, largely manganese dioxide and cupric oxide, with the addition of cobalt and silver oxides, which catalyzes the oxidation of carbon monoxide at ordinary temperatures.

Figure 4:
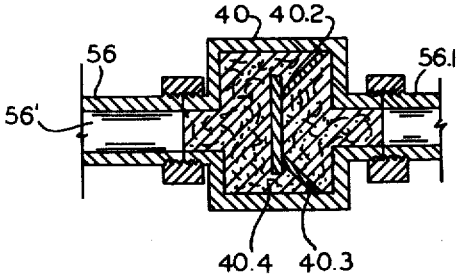
FIG. 4 is a diagrammatic cross sectional view of chamber 40.

An imperforate circular baffle 40.2 is supported in the middle of the chamber 40 in a line with yet extending perpendicular to the central longitudinal axis of channel 56 generally as shown in FIG. 4. The baffle is supported on a spider 40.3, which spider is joined to the baffle and the cylindrical chamber wall. A gas flow space 40.4 is provided between the periphery of baffle 40.2 and the interior of the wall of the chamber 40. This change in direction of flow of gas provides for contact of the gas from chamber 55 and the hopcalite mass.

This structure provides that gas flowing from the chamber 55 will be treated to remove undesired carbon monoxide while the temperature thereof is sufficiently cool for that catalyst to be most effective and prior to condensation of liquid in which carbon monoxide is soluble.

Chamber 40 is open to and rigidly attached to the cylindrical straight pipe or conduit 56 having a channel or conduit therein which channel is coaxial with and continuous with channel 56.1 and the interior of chamber 40. Tubes 56.1 and 56 are thus coaxial with and rigidly joined to each other but valves 60.1 and 60.2 may be used to bypass line 68 to line 57.3 (see FIG. 1). The cooler 57 is a conventional automobile radiator in the particular embodiment illustrated with long (2 feet long) thin walled metallic cooling tubes 57.1 operatively connected to an upper manifold 57.2 and a lower manifold 57.3. A cooler discharge outlet conduit or line 59 passes downwardly from bottom of lower manifold of cooler 57 into the top wall 61 of a condenser and collector tank 60.

The collector tank 60 is a vertically extending gas-tight tank having a top wall 61, a bottom wall 63 and a cylindrical side wall 65, all firmly joined together and to conduits 59, 66 and 69.

A conventional sight glass 62 provides for determining the level of liquid in the chamber C enclosed within collector tank 60 and emptying that tank as necessary. The sight glass is operatively connected through side wall 65 of the collector tank 60 in conventional gas-tight manner to chamber C.

The bottom wall 63 of the chamber 60 is operatively connected to a vertically extended collector pipe or line 66 through a cut-off valve 66V; line 66 is thereby operatively connected to the condensate storage tank 67. The tank 67 has a discharge line 67.1 and a cut-off valve 67.2. The line 66 is a pipe with a channel therein that is connected in gas-tight manner to the bottom of tank 60 and top of tank 67; the height of line 66 is several feet so that the vacuum created by pump 82 does not inhibit discharge from the outlet 67.1 of tank 67.

A lower condenser outlet line 69 is a vertical pipe with a channel therein which channel is operatively connected in gas-tight manner at its bottom to the top of collector tank 60 and at its top to a silencer 70. An upper condenser line 71 is a rigid pipe with a channel therein which extends from and connects to the top of the silencer 70 and enters an air-tight and water-tight absorber tank 46 containing baffles as 48 and a carbon monoxide absorbing liquid 47 as ammoniacal or hydrochloric acid solutions of cuprous chloride (the ammoniacal solution is preferred). An aqueous sodium bicarbonate solution may also be used in a separate tank to remove $CO_2$. The line 71 extends to near the bottom of the absorber tank 46 which may be filled and/or emptied through valves 46.1 and 46.2, respectively. Silencer 70 includes an orifice plate to stop noises.

The inlet of an absorber tank discharge line or pipe or conduit 72 is operatively connected to top of tank 46. Line 72 is provided with a test jet valve 75 at a tee 72T and line 72 is connected to a filter inlet of a filter casing 77 and a filter body 76 is held in a gas-tight filter casing 77. A filter outlet line 79 is operatively connected to and passes from the outlet of the casing 77 to a tee 80 whereat a pressure gauge is located and line 79 also passes to a regulator valve 81 operatively connected to and leading to the inlet 82.1 of a conventional rotary pump 82. The pump 82 is driven by a motor 84 and that pump has a discharge 82D with an outlet operatively connected to a discharge line 83. The pump discharge line 83 is a rigid metal pipe with a channel therein and such line is provided with a tee 85T and a test jet 85 which is connected to that tee through a cutoff valve 85V. The line 83 extends from the discharge 82D of the pump 82 past tee 85 to a tee 86. Distribution tee 86 is connected by an adjustable throttle valve 87 to a conventional union or sleeve connector 89. Sleeve 89 provides for ready separation of the line 83 from the tank 90 when needed as on replacement of that tank by another tank.

The storage assembly 100 comprises a balance tank 95 and a storage tank 90 and pipes and valves associated therewith. A disconnectable sleeve connector 89 provides for gas-tight connection between assembly 100 and the remainder of the generating assembly 18 or for separation of the assembly 100 therefrom.

Storage tank 90 has a top cutoff or gate valve 91 and an throttle valve 92 and a pressure gauge 93. The balance tank 95 is located with its bottom at a somewhat greater height than the top of tank 90 although it has the same volume or a larger volume than the tank 90. Storage tank 90 is an elongated cylindrical tank adapted for containing gas at high pressure. An air-tight and gas-tight interconnecting balance tank feed line 96 extends from the bottom of tank 95 to a quick disconnect coupling 90.1. A float valve 98 on the balance tank provides for freely passing air but not liquid 99 out of tank 95. The liquid 99 which extends from the tank 90 to the tank 95 is a liquid as water in which the gas to be collected in the space 90S above the liquid 99 in the tank 90 is substantially insoluble and with which it does not react. The selective valve 98 passes air but not water, hence provides for that the bottom of tank 90 is operatively connected to displacement line or conduit 97, a cutoff valve 97.1 and therethrough, serially, to the cutoff valve 96.1, the line 96 and the bottom of tank 95. The connector 90.1 provides for separation of the tank 90 from the balance tank 95 when the tank 90 is full. The sleeve connector 90.1 (between cutoff valves 97.1 and 96.1) provides, with sleeve 89 for separation of tank 90 from system 18 when full and its replacement by another like tank for filling with gas.

In operation, tank 90 is filled with water prior to adding combustible gas mixture thereto and tank 95 is connected thereto by lines 96 and 97. Tank 95 is filled initially only to a level such that filling of the tank 90 with gas and displacement of all the liquid 99 initially in tank 90 into tank 95 displaces all the gas as 99G initially in tank 95 over the level of the liquid 99 in tank 95. This addition of all the liquid initially in tank 90 also fills tank 95 with liquid whereupon valve 98 closes when such tank 95 is filled with liquid (which occurs after all of the gas in that tank has been displaced by the liquid theretofore in tank 90). Valve 98 is connected to the very top of the tank 99.

This arrangement of tanks 90 and 95 provides that additions of gaseous mixture to tank 90 beyond that required to fill the tank 90 at only slightly over atmospheric pressure serve only to increase the pressure in the tank 90 but do not displace further liquid therefrom whereby the tank 90 is filled with combustible mixture under pressure without admixture with air.

The volume of liquid in tanks 90 and 95 is chosen so that filling tank 90 with gas at high pressure drives the liquid 99 past valve 97.1 but not past the sleeve 90.1.

By this structure, the initial filling of the tank 90 with gas results in displacement of the water in tank 90 at only modest pressure to tank 95. The height of the water in tank 95 over the top of tank 90 provides for complete discharge of the gas in the tank 90 to the place of its intended use as a house as 726. The valve 92 is connected by a consumer line 132 and valve 130 and valve 131 to the house line 129 whereat the consumer gas line is connected to gas using structures as the gas stove 128' and the gas furnace 127. As diagrammatically illustrated in FIG. 1, tank 95 is higher than tank 90 so that the bottom of tank 95 is at the level of or greater than the top of tank 90. Also, as shown in FIG. 1, the tank 60 is substantially higher than the tank 67 and the coil 45 is above and higher than the top of tank 50. The tank 50 is provided with a drain valve 50.2 leading to the tank 50.1 as well as a three-way valve 50.3 located at the upper portion of the tank 50 and below the grid 53 to provide for separating the tars and oils in the mixture of vapors and condensed tars and oils passing from bottom of coil 45 to liquor 54.

A pipe or line 101 is operatively connected to and passes from the tee 86 to an adjustable throttle valve 101V and is operatively connected through that valve to a burner feed line or pipe 102. Line 102 extends to a burner 111 through a cut-off valve 104 and a tee 105. The cutoff valve 104 provides for disconnection of the storage assembly 100 from the burner 111. Burner 111 is firmly supported on ground 120 below grid 126 and hood base 25. A branch of the tee 105 in line 102 is operatively connected to and fed by a reserve fuel chamber 109.

The lines 102 and 108 are operatively connected through the tee 105 to a jet 111 to create a flame 112 which heats the retort 20 within the hood base 25.

Reserve fuel chamber 109 is operatively connected to line 108 through a cut-off valve 107, a releasable connector 106 and a cut-off valve 108V.

The start-up fuel chamber 109 is operatively connected by cut-off valves 109' and 109'' and connector 109''' to line 102, so that such chamber may be filled from tank 90 when such tank 90 is under pressure preparatory to the separation of the tank 90 from the system 18 when the system is used to fill many tanks such as 90 in a series and one of such series is intended to be shortly disconnected and start-up would require another source of heat for the coal, as 39, in chamber 21.

An insulated vertical wall 128 separates assembly 20 from remainder of assembly 18. Coal 39 is a high volatile sub-bituminous coal from Navajo Mine of Arizona Public Service, Four Corners Area.

Figure 6:
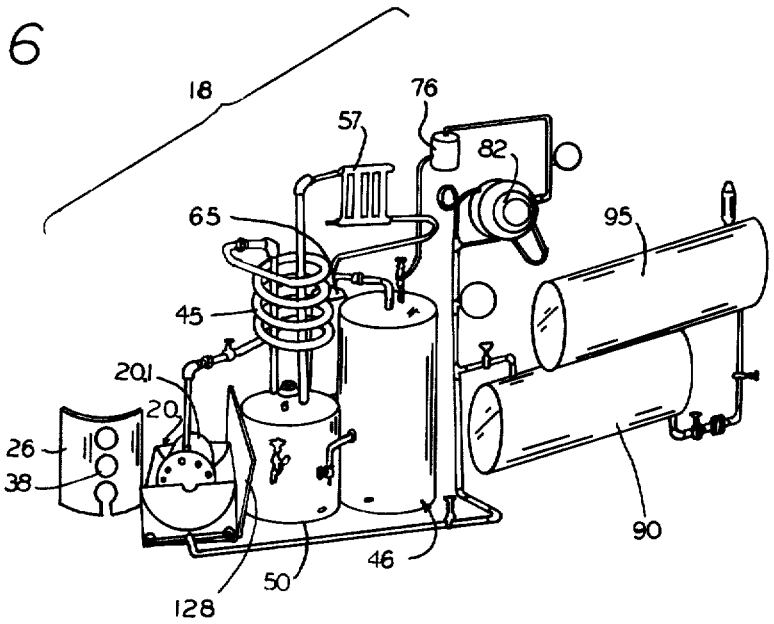
FIG. 6 is a pictorial view of the embodiment shown in FIG. 1.

FIG. 6 is a pictorial view of system as shown in FIG. 1 except for that chamber 40 is not used therein and the hood 26 of assembly 25 is removed from frame 25 for purpose of illustration of interior of retort assembly 19 and retort tank 20.1 is not rotatably mounted. This FIG. 6 illustrates that the entire assembly 18, shown in FIG. 6), including tanks 90 and 95, occupy a space only about 3 by 10 feet in area, hence is readily installed in a garage or transported in a truck: the connections between parts are simple and can be effected with hand tools as diagrammatically illustrated in FIG. 1.

To start the operation of the system 18, the cover 26 is removed from its base 25 and shell 22 is disconnected from the cover 24 by release of all the wing nuts as 34 and 34' connecting the lid 24 to the shell or wall 22. The shell 22 and wall 23 and shaft 29 are then lifted up or tilted as shown in FIG. 2 and a load of coal 39 is placed in the chamber 21. Thereupon, the wing nuts are tightly connected to the shell 22 and the chamber 21 is thereby rendered air-tight; thereupon the hood 26 is placed on top of the base 25. The charge 39 of coal is, in the particular embodiment shown, composed of 44 pounds of pea size coal, free of dust to improve the porosity of charge. The chamber 21 is sealed shut by nuts as 34 in a substantially air-tight manner. Generally, air leakage is minimized but it is utilized to destroy carbon monoxide that might otherwise render the collected product dangerous. Chamber 21 is heated to between 700° and 900°F. and maintained at such temperature during gasification of the feed (39). Temperature is monitored in chamber 21 by a standard thermoelectric sensing element as 31 located in the chamber 21 and operatively connected to and actuating a gauge or visible indicator 113, or the exhaust temperature may be monitored at holes as 38 in the hood top 26. The gas for heating the coal in such initial stage of operation is supplied from chamber 109 via line 108 and open valve 108V and open valve 107 while the cut-off valve 104 is closed.

On such initial heating, a gas mixture composed generally as set out in Table I, column 2, is produced, although the usual variation in range of such components when any of a large variety of coal is used is not particularly significant for this apparatus. [Table I herebelow]

The hot vapors evolved from tank 20.1 also include vapors of tars and oils. The tars have a specific gravity in excess of 1.0 (compared to water) and usually 1.07 to 1.09 and settle to the bottom of tank 50; such hot vapors condensed also include 2-½ to 3 gallons of light oil motor fuel per ton of coal. The oils condense and have a specific gravity less than 1.0; the fuel fractions are vaporized in chamber 50. These fuel fractions are materials having substantial portion thereof with boiling points less than 100°C. (212°F.) and are useful as motor fuel and are collected in tanks 60 and 67. Carbolic acid, creosote, phenols and sulfur compounds, such as thiocyanates and thiosulfides, are collected in the liquor 54 and retained in chamber 50 and collected as a waste product in tank 50.1.

After such loading of chamber 21 and heating of its contents by the source 109, the initial stage of operation of the system is evidenced by audible bubbling or gurgling sounds developed in the washer 50 due to passage of gas through the liquid 54.

The dimensions of the particular embodiment 18 are set out in Table Ii herebelow.

After a few minutes of operation, the output sput or vent of valve 75 provides an orange flame. Tee 72.1 in line 72 has a valve 75 with an output sput or vent thereon for provision of the flame 75F and the valve 75 is a throttle valve. This flame indicates the displacement of air from all points between the valve 75 and the retort chamber 21.

Vent 85 does not provide a combustible mixture for about 5 minutes after a flame is provided at output sput or vent of valve vent 75. It would be noted that the tee 85T feeding to the valve 85V is as close as possible to tee 86 from which the line 101 leads to the burner 111 and from which also the valves 87 and 91 lead to the tank 90. Vent 85 is a sput or short pipe at end of valve 85V.

After vent 85 lights, the pump 82 is started and produces 3 to 5 p.s.i.g. vacuum in line 79 and produces a discharge pressure of 150 to 180 p.s.i.g. in line 83. After vent 85 is lit and pump 82 is running, valve 104 may be opened and gas may be passed from pump discharge line 83 to tee 86 and line 101 and line 102 and valve 104 and burner 111 to produce heat at flame 112 for the heating of the coal 39 in chamber 21. The valve 106 is then closed then the valve 104 is opened whereby the overall cycle of gas production in chamber 21, storage in tank 90, burning at flame 112 and passage of gas to its utilization is balanced with enough gas passing to the flame 112 to maintain the desired temperature of 700° to 900°F. in chamber 21 while producing excess gas and storing the gas so produced in tank 90. The vacuum produced by the pump 82 is read at gauge 80 while the discharge pressure of pump 82 is read when a steady state is reached at the gauge 93 at tank 90.

Completion of gasification is indicated by cessation of the bubbling moise in washer 50. At such time, 44 pounds of bituminous coal produces ¼ gallon of gasoline at discharge 67.2 and 440 cubic feet of gas. Two tons of coal will produce 7 gallons of gasoline and 44,000 cubic feet of gas at standard temperature and pressure; however, the high pressure produced by the pump provides for the ready storage of a large amount of gas in the tank 90.

Coke, tar, liquor and gas produced by this process vary according to the particular method of carbonization and the nature of coal used.

Generally for every 100 units of heat contained in the coal carbonized, 24 appears in the gas, 42 in the coke and 5.6 in the tar, for an overall efficiency of 71.6%, with 28.4% used in the manufacture. The use of the coke provides for substantially complete transfer of the gasification possibility of the coal to gas with the coke left over at each batch operation emptied from the container 21, as shown in FIG. 3, and deposited on the grid 126. The gas from burner 111, whether provided from tank 90 or from tank 109, provides for igniting the coke and providing the heat to the furnace walls containing such coke (127) to ignite that coke to provide a flame as 112 for heating of the mass of coal (39) in the chamber 21. Additionally, gasoline is collected which is usable for automobile fuel as well as gas being collected for use in gas stoves and gas furnaces.

The completion of gasification is indicated by a cessation of the bubbling noise in the washer 50.

Figure 5:
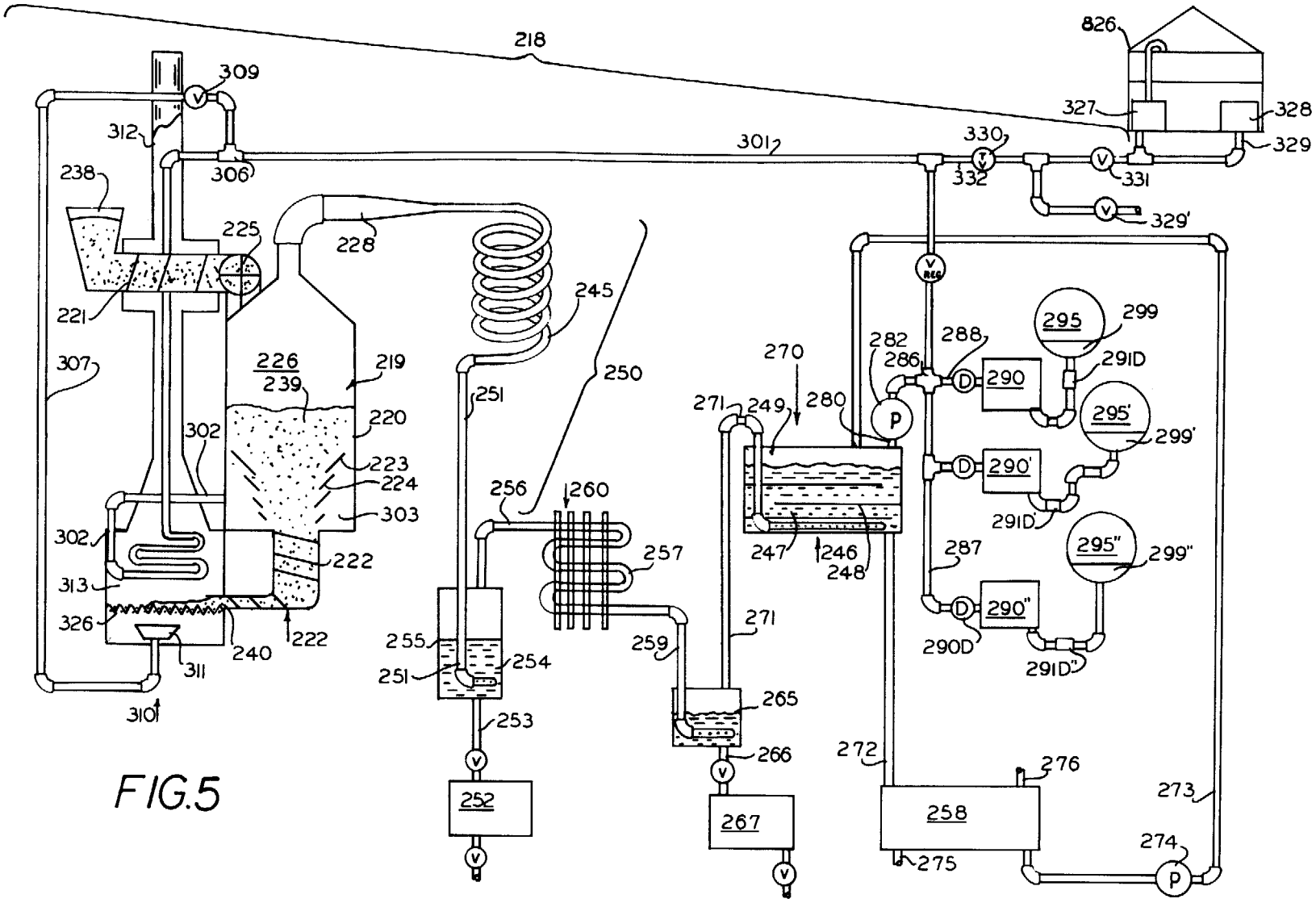
FIG. 5 is a diagrammatic view of a system for continuous operation.

According to another embodiment of this invention (as shown in FIG. 5), a retort assembly 219, a washer assembly 250, a condenser and collector assembly 260, an absorber assembly 270 and a pump and storage assembly 300 and a heating assembly 310 are provided in operative combination. This embodiment 218 provides for continuous operation rather than a batch operation (as shown in FIG. 1). In embodiment 218, the retort subassembly 219 comprises a retort tank 220 in shape of a vertical right cylinder with a feed conveyor 221 and a discharge conveyor 222 operatively connected thereto. The tank 220 has cylindrical side walls and a louvered conical bottom 223 with circular spaces as 224 between the circular conical portions of the louvered conical bottom and a circumferential manifold 303. The top, horizontal feed conveyor 221 is a screw conveyor that feeds through a star wheel 225 into the top of chamber 226 of the tank 220 while solid material is discharged from horizontal discharge screw conveyor 222 at bottom of tank 220 onto grid 326 in the heating assembly 310.

The heating assembly 310 comprises a furnace chamber 313, a vertically extending chimney 312 on top of the chamber, a grid 326 in the chamber adjacent discharging conveyors 222, heat transfer tubes 302 above the grid and below the chimney and a gas burner 311 below the grid.

The washer assembly 250 comprises a cooler coil 245 and a washer tank 255. The inlet of coil 245 is connected to discharge 228 of retort chamber 226. The outlet of coil 245 is operatively connected to a vertical line 251 leading into the vertically extending washer tank 255 and extending to near the bottom thereof yet spaced away therefrom; the discharge end of line 251 extends below the level of liquid 254.

The end of line 251 extends to below the top level of a liquor 254 — a brine — in tank 255. Tank 255 is connected at its bottom to discharge chamber 252 by discharge line 253 and to coil 257 by a pipe or line 256. A cooler coil 257 is connected by line 259 to top of separator tank 265. Tank 265 connects by line 266 to a valved gasoline collector chamber 267. An absorptive solution 247 for carbon monoxide is held in a tank 246 of assembly 270. The top of chamber of tank 265 is connected to tank 246 by line 271; tank 246 has baffles 248; line 280 connects to the upper wall of tank 246 and the upper portion of chamber 249 of tank 246 and pump 282 inlet. The discharge of pump 282 is connected to tee 286 and tee 286 connects by line 287 into each of a battery of tanks or chambers as 290, 290', 290'', each of which tanks is connected by a U-tube as 291D, 291D' and 291D'' to balance tanks as 295, 295' and 295'', respectively, which pairs of tanks (290–295, 290'–295') contain jointly volumes of water as 299, 299' and 299'' and operate and are related functionally as above described for tanks 90 and 95 and the volume of water 99 therein. Tee 286 also connects to a gas cycle line 301 and a house line 329.

The bottom of tank 246 is connected to one end of a discharge line 272; the other end of which line is connected to a regeneration tank 258. The outlet of the tank 258 is connected to a recycle line inlet line 273. The outlet of the recycle line is connected to the top of tank 258 through a pump 274. The same solution is used in tank 246 as is used in tank 46 for absorption of carbon monoxide. Inlet 275 and outlet 276 in 258 provide for addition and removal of gases (as air) to regenerate the liquid 247 of tank 246 passed to tank 258.

The process of embodiment 218 continuously provides combustible gas mixtures in tanks 290, 290' and 290'' from the coal 239 in tank 220 and supplies home users of gas, as at 826.

In operation of embodiment 218, the coal mass 239 is fed into chamber 226 by the screw conveyor 221 from a source 238 of such coal.

The mass of coal 239 is heated at 700° to 900°F. to form coke 240 and evolves a first vapor mixture from mass 239, such mixture comprising vapors of tars, oils, natural gasoline and hydrogen, methane and carbon dioxide. Due to vacuum-producing action of pump 282, the pressure in chamber 226 is 3 to 5 p.s.i. below atmospheric pressure. The vapors pass out of chamber 226 by line 228. Coke 240 passes along the conveyor 222 onto a grid 326 and is burned in furnace 310. The combustion gases from burning of such coke passes up chimney 312 and heats the gas passed through pipe 301 within that chimney.

The vapors of the tars and oils from the first vapor mixture in chamber 226 condense in coil 245. The condensed tars and oils are washed and collected in chambers 255 and 252 and in 255 separated from the remaining vapors, which provide a second vapor mixture. That second vapor mixture passes through line 256 to coil 257 where condensing and separating of the gasoline vapors from that said second vapor mixture occurs and produces a third vapor mixture that is passed out of tank 265 via line 271 and liquid gasoline that is collected in tank 265: such liquid is passed downwardly by vertical line 266 to a collecting tank 267 from which it may be dispensed, overcoming the vacuum effect of pump 282 by the height of line 266.

Carbon monoxide in the third vapor mixture is removed in tank 246 to produce a fourth vaporous mixture in line 280; pump 282 raises the pressure of that fourth vaporous mixture to a pressure about 150 p.s.i. above atmospheric pressure;

The cross 286 divides the pressurized fourth vapor mixture comprising methane and hydrogen from pump 282 into at least two parts sending one part by line 288 to storage tank 290 while burning the coke 240 to heat a second part of said fourth vapor mixture (from line 301) in heat transfer tubes 302 and passing the thus heated part of said fourth vapor mixture into a manifold 303 and then through spaces 224 to contact with fresh portions of the coal and thereby evolving added portions of the above first and second and third and fourth vapor mixtures and producing further portions of coke. A portion of the fourth vapor mixture in line 301 may be passed by tee 306 and a cut-off valve 309 by a line 307 to a burner 311 whereby to initiate combustion of the coke on grid 326 in chamber 310. Heat transfer between chimney 312 and feed conveyor 221 to chamber 226 is also provided as shown in FIG. 5.

The liquor in tank 246 is passed to tank 258 to be regenerated and then returned to tank 246 (for reuse) by pump 274 and line 273. The line 301 is connected by a consumer line 332 and valve 330 and valve 331 to the house line 329 for a house as 826 whereat the consumer gas line is connected to gas using structures as the gas stove 328 and the gas furnace 327. Another line as 329' provides gas for another house. Each of the tanks 290, 290' and 290'' may be separately filled and then separated from the line 287 as above described for tanks 90 and 95 and each of tanks 290, 290' and 290'' is provided (at D) with disconnect valves and couplings as 87 and 91 and disconnectable couplings as 89 and (at 291D, 291D' and 291D'') with valves as 97.1 and 96.1 and disconnectable couplings as 90.1.

Analyses of coal 39 are available in U.S. Geologic Survey 1972 Report, Southwest Energy Study Report, Appendix J, Part II, Tables 2A and 3A.

TABLE I

GAS PRODUCED BY HEATING COAL

| Column 1: Components | Column 2 |
|---|---|
| Oxygen | 0.2 |
| Carbon Dioxide | 4.5 |
| Unsaturated hydrocarbons | 3.8 |
| Carbon Monoxide | 8.3 |
| Hydrogen | 29.0 |
| Methane | 49.1 |
| Nitrogen | 5.0 |
| B.T.U. per cubic foot | 475–560 B.T.U. |
| Gas cu.ft./ton | 20–50,000 |
| Density relative to air | 0.4 to 0.8 |
| Flame Temperature | 3600° F. (1982° C.) |

TABLE II

| | | |
|---|---|---|
| Tank 21: | Diameter | 6 in. O.D. |
| | Length | 16 in. |
| | Wall Thickness | 5/16 in. |
| Coil 45: | Length | 12 in. |
| | Wall Thickness | .035 in. |
| | Helix Diameter | 10 in. I.D. |
| | Wall Diameter | 1/2 in. |
| | Pitch of Helix (longitudinal spacing of helix portion) | 2 in. |
| Tank 46: | Diameter | 12 in. |
| | Length | 39-1/2 in. |
| | Wall Thickness | 1/16 in. |
| Tank 50: | Height | 14 in. |
| | Diameter, inside | 12 in. |
| | Wall Thickness | 3/32 in. |
| | Height of baffle over floor 53 | 10–7/32 in. |
| Cooler 57: | Pipe size, o.d. (number) | 1/2 in. (11 tubes) |
| | Wall Thickness | .035 in. |
| | Wall Length | 8 in. |
| Tank 60: | Height | 16 in. |
| | Diameter | 6 in. |
| | Wall Thickness | .040 in. |
| Motor 82: | Horsepower | 1/4 H.P. |
| | r.p.m. | 1750 R.P.M. |
| Pump 84: | Input pressure | 3.5 in. Hg Neg. |
| | Output pressure | 180 PSI |
| Tank 90: | Diameter | 2 feet |
| | Length | 6 feet |
| | Wall Thickness | 1/8 in. |

I claim:

1. Apparatus for generating combustible gas mixtures and liquid gasoline from coal comprising, in operative combination, a retort assembly, a washer assembly, a condenser assembly, a pump and storage assembly and a heating assembly;

said retort assembly comprising a gas-tight retort tank and a hood, said gas-tight retort tank comprising a horizontally extending rigid imperforate cylindrical wall and one vertically extending side wall firmly attached thereto on one side thereof and another side wall removably yet firmly attached to another side of said cylindrical wall, a support for journal means for rotatably supporting said retort tank near said one side wall thereof, another support for journal means for rotatably supporting said retort tank adjacent to said other side wall; one shaft means fixed to and extending horizontally from said one side wall to said journal means on said one of said supports and rotatably supported thereon, and another shaft means fixed to and extending from the other of said side walls to the journal means on said other support and rotatably supported thereon, a retort discharge channel extending through said removably attached side wall and shaft connected thereto, and one end of a cooling coil operatively connected to said retort discharge channel; a grid support, a grid thereon, said grid below said retort tank, a gas burner being located below said grid, and the hood of said retort tank comprises a lower base and an upper perforated shell, said lower base being a rigid frame open at its top and bottom, said frame surrounding the periphery of the retort tank and, on removal of said removably attached side wall from said horizontally extending cylindrical wall, said rigid imperforate cylindrical wall of said retort tank and one vertical side wall being pivotal about a horizontal axis on said one support and said horizontally extending imperforate cylindrical wall being tiltable to a sloped position whereby to empty the content of said retort tank on to said grid, said washer assembly comprising a cooling coil and a washer tank, said cooling coil comprising a vertically extending coil, one, lower, end of said cooling coil operatively attached to said retort discharge channel, the other, discharge, end of said cooling coil operatively attached to said washer tank and extending thereinto, said washer tank comprising a vertically elongated gastight tank with top, bottom and side walls joined together and enclosing a gastight chamber therebetween, said discharge end of the cooling coil extending towards the bottom wall thereof, said washer tank having an upper outlet line operatively connected to the top thereof and to the chamber therein and extending to the inlet of a condenser;

said condenser assembly comprising a condenser and a collection tank, said condenser connected via a vertically extending tube therebelow to said collection tank, which has an upper discharge outlet and a lower discharge outlet, said lower discharge outlet connected to a collection discharge line and said collection discharge line feeding to a gasoline collector tank, said gasoline collector tank located below said collection tank;

said collection tank upper discharge outlet operatively connected to a gas-tight gas treatment chamber, said pump and storage assembly comprising a pump and a first storage tank, said collection tank upper discharge line connected via said gas treatment chamber to the inlet of said pump, a power means operatively attached to said pump, and a discharge outlet on said pump, a pump discharge line operatively connected to said pump discharge outlet, a first tee connected to said pump discharge line, one arm of said tee connected to said first storage tank through a first throttle valve and another arm of said tee operatively connected to the inlet of a second throttle valve, said second throttle valve having an outlet, said second throttle valve outlet connected to said burner below said retort tank by a line, and comprising also a second tee in said line from said first tee to said burner between said burner and said second throttle valve, two arms of which tee are connected to said line and a reserve gas storage compartment having a cut-off valve operatively connected thereto and a gas storage compartment discharge line operatively connects said cut-off valve to a third arm of said second tee whereby said burner is operatively connected to said reserve gas storage compartment.

2. Apparatus as in claim 1 wherein a third tee is located in the line between said gas treatment chamber and the inlet of said pump and a gas jet is operatively connected to said third tee and a cut-off valve is located between said gas jet and said third tee, and wherein a fourth tee is located between said pump discharge line and said first tee with two arms of said fourth tee connected to said pump discharge line and a third arm of said fourth tee connected to the inlet of a valve with the outlet of said valve operatively connected to a test jet.

3. Apparatus as in claim 2 wherein said first storage tank has at its bottom a discharge line which is operatively connected through a cut-off valve, a disconnectable coupling and a second cut-off valve to a second storage tank having an inlet at its bottom and being of a greater capacity than said first storage tank, the bottom of said second storage tank being located at the level of the top of said first storage tank, a connecting pipe from the bottom of said second storage tank to the bottom of said first tank, said line including said cut-off valve, a disconnectable coupling and a second cut-off valve between the first storage tank and said second storage tank and a valve at the top of said second storage tank which closes against passage of liquid but allows free flow of gas therethrough.

4. Process of providing combustible gas mixtures and liquid gasoline from coal, comprising the steps of a. heating a first batch of dust-free coal at 700° to 900°F. in a retort and evolving a first vapor mixture therefrom comprising vapors of tars, oils, natural gasoline and hydrogen, methane and carbon monoxide at a pressure below atmospheric pressure and producing coke in said chamber, b. condensing the tars and oils from the first vapor mixture and separating them and collecting said condensed tars and oils and thereby producing a second vapor mixture;

c. condensing and separating the resulting liquid gasoline from said second vaporous mixture and thereby producing a third vapor mixture and collecting liquid gasoline;

d. removing carbon monoxide from said third vapor mixture and thereby producing a fourth vapor mixture and raising the pressure of said fourth vapor mixture to a pressure above atmospheric pressure;

e. dividing said pressurized fourth vapor mixture comprising methane and hydrogen into two portions and passing one portion thereof to storage and use and a second portion to a burner and there burning said second portion to heat said coal to maintain the temperature in said retort in the range of 700° to 900°F. and f. after a first batch of said coal has been heated and said vapor mixtures evolved therefrom, the resultant coke is removed from the retort and passed to a grid below said retort and a fresh portion of coal is added to the retort and said coke is ignited on said grid by said second portion of said fourth vapor mixture and burned to heat said second batch of said coal and develop a second batch of each of said first, second, third and fourth vapor mixtures.

* * * * *